US006684595B1

(12) United States Patent
Sorkin

(10) Patent No.: US 6,684,595 B1
(45) Date of Patent: Feb. 3, 2004

(54) INTERSECTIONAL REINFORCING BAR SUPPORT

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 0 days.

(21) Appl. No.: 10/229,939

(22) Filed: Aug. 29, 2002

Related U.S. Application Data

(63) Continuation-in-part of application No. 09/894,269, filed on Jun. 29, 2001, now Pat. No. 6,557,317.

(51) Int. Cl.[7] ..... E04C 5/16

(52) U.S. Cl. ..... 52/685; 52/677; 52/682; 52/686

(58) Field of Search ..... 52/677, 682, 684, 52/685, 686, 687, 689; 404/134, 135, 136

(56) References Cited

U.S. PATENT DOCUMENTS

| | | | | | |
|---|---|---|---|---|---|
| 3,449,882 | A | * | 6/1969 | Ott et al. | 52/689 |
| 3,471,987 | A | * | 10/1969 | Yelsma | 52/684 |
| 3,673,753 | A | | 7/1972 | Anderson | |
| 3,788,025 | A | | 1/1974 | Holmes | |
| 4,063,397 | A | * | 12/1977 | Follows | 52/684 |
| 4,598,523 | A | * | 7/1986 | Tolliver | 52/685 |
| 4,835,933 | A | | 6/1989 | Yung | |
| 5,555,693 | A | | 9/1996 | Sorkin | |
| 5,791,095 | A | | 8/1998 | Sorkin | |
| 5,893,252 | A | | 4/1999 | Hardy, Jr. et al. | |
| 6,112,494 | A | | 9/2000 | Hardy, Jr. et al. | |
| 6,276,108 | B1 | * | 8/2001 | Padrun | 52/684 |

FOREIGN PATENT DOCUMENTS

| | | | | | |
|---|---|---|---|---|---|
| DE | 2228868 | | * | 1/1974 | E04C/5/16 |
| FR | 1477159 | | * | 3/1967 | 52/684 |
| GB | 1042727 | A | * | 9/1966 | E04C/5/16 |
| GB | 2088434 | A | * | 6/1982 | E04C/5/16 |
| GB | 2139664 | A | * | 11/1984 | E04C/5/16 |
| GB | 2158848 | A | * | 11/1985 | E04C/5/16 |
| GB | 2215355 | A | * | 9/1989 | E04C/05/20 |
| JP | 328718 | A | * | 11/2000 | E04C/5/18 |

* cited by examiner

*Primary Examiner*—Brian E. Glessner
(74) *Attorney, Agent, or Firm*—Harrison & Egbert

(57) ABSTRACT

A concrete reinforcing bar support having a base, a support structure extending upwardly from the base and having a channel formed at an upper surface thereof, a first clamping structure affixed to the support structure on one side of the channel, and a second clamping structure affixed to the support structure on an opposite side of the channel. Each of the clamping structures has a curved element extending inwardly therefrom. A first rebar extends through the channel. A second rebar is retained by the first and second clamping structures in a direction transverse to the first rebar.

9 Claims, 4 Drawing Sheets

INTERSECTIONAL REINFORCING BAR SUPPORT

RELATED U.S. APPLICATIONS

The present application is a continuation-in-part of U.S. patent application Ser. No. 09/894,269, filed on Jun. 29, 2001, and entitled "Concrete Reinforcing Bar Support", now U.S. Pat. No. 6,557,317.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to devices for use in connection with construction. More particularly, the present invention relates to reinforcing bar chair apparatus for use in reinforced concrete construction. Furthermore, the present invention relates to intersectional chairs used with reinforced concrete construction.

BACKGROUND OF THE INVENTION

In reinforced concrete construction applications, such as highways, floors, or walls of buildings, spacer devices, commonly referred to as chairs, are required for supporting and maintaining reinforcing rods or bars which are positioned in the area where concrete is to be poured. These reinforcing rods are sometimes referred to as "rebars". Depending on such parameters, such as the total surface area and the thickness of the end product of concrete, reinforcement is mandated in varying degrees by building codes. One such method of reinforcement involves a steel mesh, while in major concrete construction, such as highways and high-rise buildings, reinforcing rods of various diameters, typically one-half inch or more, are required. In addition, on such jobs, the reinforcing bars may be positioned in spaced layers due to the thickness of the floor. In some installations, a first layer of rebar is provided, with the reinforcing rods or rebars in spaced parallel relationship, and generally parallel to the surface on which the concrete is to be poured. A second layer of rebar is then added, with the orientation of the second layer perpendicular to the first layer, thus forming a grid or lattice work. After the reinforcing bars or lattice work is prepared, the concrete is then poured over this grid or framework, which is ultimately embedded within the highway floor or wall.

For a concrete floor on a prepared surface, spacers or chairs are utilized for providing the vertical separation of the rebar grid from the surface on which the concrete is to be poured. The prepared surface may be a wood, plywood, or foam structure or a compacted surface, the latter of which my be provided with a layer of compacted sand, with a plastic sheet covering thereon providing a moisture barrier. Spacers or chairs are then positioned on the prepared surface for supporting the rebars in a plane generally parallel to the prepared surface. Typically, with modem building codes, a spacer is needed for every linear foot of the rebar.

With rebar spacers or chairs, one common problem is occasioned by the number of different sizes required to be maintained by a supplier to accommodate different thicknesses of poured concrete, such as two-inch, three-inch, four-inch, etc. and many intermediate fractional sizes. Another common problem with rebar spacers has been encountered in the method of securing the rebar to the chair or spacer, with twisted wire being the most common method. This particular problem is more acute when mutually perpendicular layers of rebar are coupled to the same chairs or spacers. With wire connections, a first strip of wire secures the first layer and a second strip of wire secures the perpendicular layer of rebar. With any metal or wire within the reinforcing bar grid work, there is a problem with rusting or decomposing of the wire or metal components.

In the past, various patents have issued relating to these chair supports for reinforcing rods. In particular, the present inventor is the owner of U.S. Pat. Nos. 5,555,693 and 5,791,095 for such chairs. Each of these chairs has a receiving area with a horizontal section and a generally parabolic section extending transverse to the horizontal section. A plurality of separate legs extends downwardly from the receiving area. Each of the legs has a foot extending horizontally outwardly therefrom. The receiving area and the plurality of legs are integrally formed together of a polymeric material.

U.S. Pat. No. 3,788,025, issued on Jan. 29, 1974 to S. D. Holmes, describes a chair for supporting in right angular relation two reinforcing rods used in construction. The chair has a lower arched base part and an upper rod supporting part integral with the base. The base is an arched support with means for providing lateral, longitudinal, vertical support and strength. The rod supporting part comprises two spaced apart arms, the lower parts of which form a saddle for receiving one reinforcing rod and the upper part for each of which is formed by two separate spaced upstanding inwardly concave arms, the upper ends of which are spaced to provide an opening through which a second reinforcing rod, arranged at a right angle to the first rod, may be introduced.

U.S. Pat. No. 3,673,753, issued on Jul. 4, 1972 to G. C. Anderson, teaches a concrete reinforcing bar support in which a base supports an upright pedestal. A lower clamping portion is supported by the pedestal which has a first rod-receiving open passageway therethrough. Resilient detents extend from the lower clamping portion to retain a reinforcing rod disposed through the first passageway. An upper clamping portion is provided which includes a pair of hook members extending from the lower clamping portion. Each of the hook members has a mouth opening in the same direction to define a second rod-receiving passageway which is normally disposed to the first passageway.

U.S. Pat. No. 4,835,933 issued on Jun. 6, 1989 to F. P Yung, describes a spacer assembly which includes a spacer with a body having a base portion with a generally centrally disposed support post portion. One end of the support post portion is formed as a planar surface with a centrally located generally concave saddle portion configured for receiving a reinforcing bar. The planar surface is provided with apertures therethrough on both sides of the saddle. A clamp member is provided for simultaneously securing mutually perpendicular rebars to the chair. The clamp member is a generally U-shaped lower portion, with the depending arms thereof in spaced generally parallel relationship for engaging a first bar within the saddle. A generally identical pair of hook arms extends upwardly from the bight portion. The hook arms are oriented for engaging a second rebar in an orientation perpendicular to the first rebar engaged within the saddle portion.

U.S. Pat. No. 5,893,892, issued on Apr. 13, 1999 to Hardy, Jr. et al, teaches an apparatus for fixating and elevating an interconnected rebar lattice having individual longitudinal and transverse rebar intersections. The apparatus includes a holding portion having an open-ended recess with two opposing walls being generally U-shaped. The recess has longitudinal access and is sized and shaped to receive a longitudinal rod. An arc-shaped portion extends laterally outwardly from each opposing wall and perpendicular to the longitudinal access of the recess. The arc-shaped portion includes a recess and an opposing wall with each wall including a snap-type lock. A locking member has a generally arc-type portion and includes a snaptype lock for attaching to the arc-type portion and engaging with the snap-type lock of the arc-type portion. A leg portion extends downwardly from the holding portion and is integrally attached to a base.

It is an object of the present invention to provide a bar support which is corrosion-proof.

It is another object of the present invention to provide a bar support that is adaptable to receive various diameters of rebar therein.

It is another object of the present invention to provide a bar support adapted for use at intersections of rebars.

It is another object of the present invention to provide a bar support that can be placed on various flat surfaces.

It is another object of the present invention to provide a bar support that can be easily snap-fitted onto and locked around a reinforcing bar.

It is another object of the present invention to provide a bar support which allows a free flow of concrete therethrough.

It is a further object of the present invention to provide a bar support with a load-resistant stable support structure.

It is a further object of the present invention to provide a reinforcing bar support which is easy to use, easy to manufacture and relatively inexpensive.

These and other objects and advantages of the present invention will become apparent from a reading of the attached specification and appended claims.

BRIEF SUMMARY OF THE INVENTION

The present invention is a concrete reinforcing bar support comprising a base, a support structure extending upwardly from said base and having a channel formed in an upper surface thereof, a first clamping structure affixed to the support structure on one side of said channel, and a second clamping structure affixed to on an opposite side of said channel. A first rebar is received in the channel of the support structure. A second rebar extends in a transverse direction to the first rebar and is retained by the first and second clamping structures position above the first rebar.

Each of the first and second clamping structures includes a generally U-shaped member extending flexibly upwardly from the support structure, a first retainer affixed to an upper end of one side of the U-shaped member, and a second retainer affixed to an upper end of an opposite side of the U-shaped member. Each of the first and second retainers extends inwardly and downwardly from the upper end of the U-shaped member. Each of the first and second retainers has a curved element extending inwardly of the U-shaped member. These curved elements will bear resiliently against the exterior surface of the second rebar received therein. The curved elements have a concavity facing away from each other. Each of the curved elements has a curvature of greater that 90° and less than 180°. The curved elements each have an end spaced from the sides of the U-shaped member and spaced above a bottom of the U-shaped member.

Each of the first and second clamping structures is positioned above the channel. The second rebar will reside in a position above the first rebar. The base, the support structure and each of the first and second clamping structures are integrally formed together of a polymeric material. The support structure has a plurality of holes formed therein so as to allow concrete to material. The support structure has a plurality of holes formed therein so as to allow concrete to flow freely therethrough.

In an alternative embodiment of the present invention, each of the first and second clamping structures comprises a generally U-shaped member extending upwardly from the support structure, a curved element extending angularly inwardly from one side of the U-shaped member, and a second plurality of ribs extending angularly inwardly from an opposite side of the U-shaped member. Each of the plurality of ribs extends angularly downwardly toward a bottom of the U-shaped member so as to reside in resilient contact with the second rebar received therein.

DETAILED DESCRIPTION OF THE INVENTION

Figure 1:
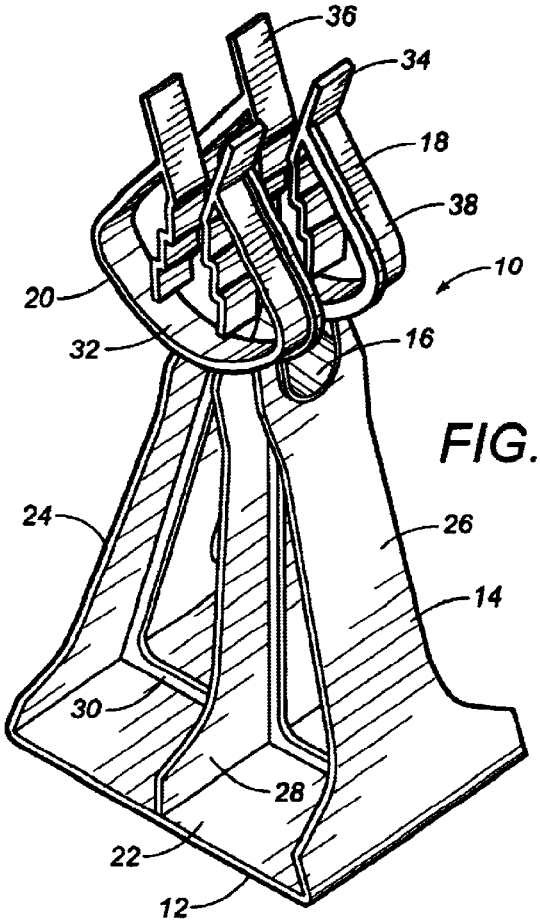
FIG. 1 is a perspective view of an embodiment of the bar support apparatus of the present invention.

Referring to FIG. 1, there is shown at 10 the bar support apparatus of the present invention. The bar support apparatus 10 includes a base 12, a support structure 14 extending upwardly from the base 12 and having a channel 16 formed at an upper surface thereof, a first clamping structure 18 affixed to the support structure 14 on one side of the channel 16 and a second clamping structure 20 affixed to the support structure 14 on an opposite side of the channel 16. As will be described hereinafter, a first rebar will be received within the channel 16. A second rebar will be received within the clamping structures 18 and 20 so as to extend above and transverse to the rebar within the channel 16.

In FIG. 1, it can be seen that the base 12 has a generally rectangular configuration. The base 12 will have a flat bottom surface 22 so as to reside upon an underlying surface.

The support structure 14 has a first leg 24 and a second leg 26 extending angularly inwardly from the base 12. Legs 24 and 26 have a generally inverted T-shaped configuration. Intermediate leg 28 extends vertically upwardly from the base 12 between the legs 24 and 26. The intermediate leg 28 will also have a generally inverted T-shaped configuration. The legs 24, 26 and 28 are generally planar members converging toward the upper surface of the support structure 14. Bracing structure 30 extends between the legs 24, 26 and 28 so as to provide structural rigidity to the support structure 14.

The channel 16 has a generally U-shaped construction. Channel 16 will have a suitable interior so as to receive the rebar therein.

The first clamping structure 18 has an interior surface suitable for receiving the second rebar therein. Similarly, the second clamping structure 20 will have an interior surface 32 suitable for extending the rebar therethrough. Each of the clamping structures 18 and 20 has a particularly unique configuration so as to properly retain the rebar in a position that is above the rebar that is received within the channel 16. Each of the clamping structures 18 and 20 extends in generally spaced parallel relationship to each other. The first clamping structure 18 includes lever portions 34 and 36 extending upwardly from the top end of the generally U-shaped member 38. Similarly, the second clamping structure 20 will include similar lever portions. The first clamping structure 18 has an identical configuration to the second clamping structure 20.

Figure 2:
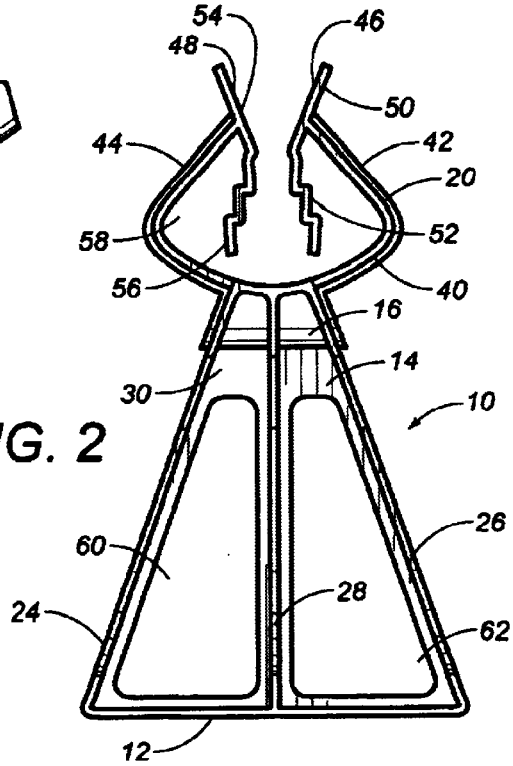
FIG. 2 is an end view of the bar support apparatus of the embodiment of FIG. 1 of the present invention.

FIG. 2 particularly illustrates the configuration of the clamping structure 20. It can be seen that the clamping structure 20 is affixed to the upper surface of the support structure 14. The second clamping structure 20 has a generally U-shaped member 40 having sides 42 and 44 converging toward each other. The generally U-shaped member 40 extends flexibly upwardly from the support structure 14. A first arm 46 is affixed to an upper end of side 42 of U-shaped member 40. A second arm 48 is affixed to the upper end of the opposite side 44 of the U-shaped member 40. The first arm 46 includes a lever portion 50 and a retaining portion 52. Similarly, the second arm 48 includes a lever portion 54 and a retaining portion 56 therein. The lever portions 50 and 54 extend upwardly and outwardly from the upper ends of the sides 42 and 44, respectively. These lever portions 50 and 54 serve to "funnel" the rebar into the interior 58 of the U-shaped member 40. Also, the lever portions 50 and 54 can be used so as to facilitate the flexible spreading of the sides 42 and 44 away from each other so that a relatively large diameter section of rebar can be retained therein.

The retaining section 52 of the first arm 46 is contiguous with the lever portion 50. Similarly, the retaining portion 56 of the second arm 48 is contiguous with the lever portion 54. The retaining portions 52 and 56 face each other within the interior 58 of the U-shaped member 40. Each of the retaining portions 52 and 56 has a generally zig-zag cross-section. This zig-zag cross-section will more securely retain itself against the corrugations and irregular surfaces of the rebar retained therein.

In FIG. 2, the support structure 14 for the bar support apparatus 10 is more particularly illustrated. In particular, legs 24 and 26 extend angularly upwardly and inwardly from the base 12. Intermediate leg 28 also extends vertically upwardly from the base 12. Bracing structure 30 extends transverse to the legs 24, 26 and 28 so as to provide structural integrity for the support structure 14. Channel 16 is formed in the upper surface of the support structure 14. Holes 60 and 62 are formed in the support structure 14 so as to allow for the free flow of concrete therethrough.

Figure 3:
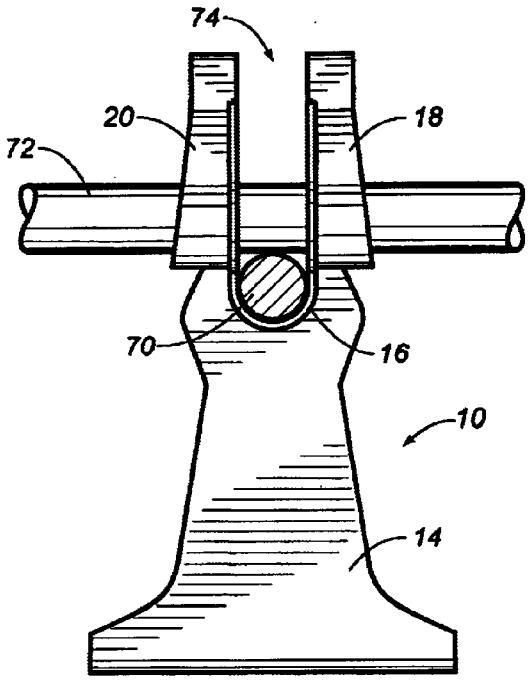
FIG. 3 is a side elevational view of the bar support apparatus of FIG. 1 of the present invention showing the rebar retained therein.

FIG. 3 shows the rebar support apparatus 10 of the present invention having a first rebar 70 and a second rebar 72 illustrated as retained within the channel 16 thereof and by the clamping structures 18 and 20. Initially, the first rebar 70 is installed through the space 74 between the clamping structures 18 and 20. The rebar 70 will be easily retained within the channel 16 at the upper surface of the support structure 14. The second rebar 72 is positioned so as to be pushed downwardly between the lever portions 50 and 54 of the arms 46 and 48 associated with the clamping structures 18 and. 20. As a result, the rebar 72 will overlie the rebar 70 in transverse relationship thereto. As such, the reinforcing bar support apparatus 10 of the present invention will serve as a "intersectional chair".

Figure 4:
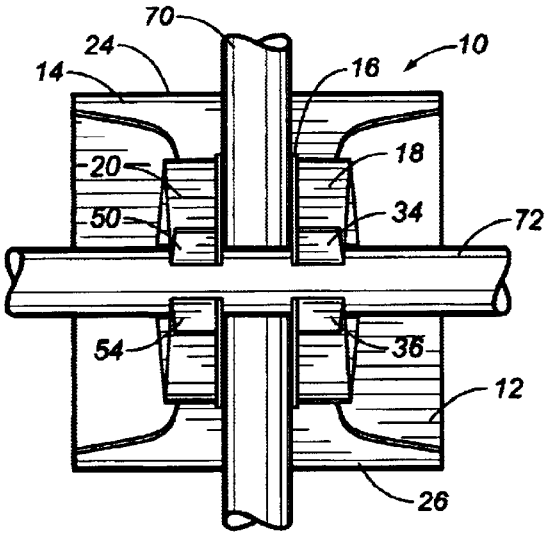
FIG. 4 is a plan view of the bar support apparatus of FIG. 1 of the present invention showing the rebar retained therein.

FIG. 4 is a plan view of the reinforcing bar support apparatus 10 of the present invention. Rebar 70 is illustrated as extending in transverse relationship to rebar 72. Rebar 70 is illustrated as being retained within the channel 16 at the upper surface of the support structure 14. Legs 24 and 26 extend angularly outwardly below the channel 16 so as to provide stability for the apparatus 10. Rebar 72 has been placed between the lever portions 34 and 36 of the clamping structure 18. Similarly, the rebar 72 is illustrated as having been pushed between the lever portions 50 and 54 of the second clamping structure 20. The retaining portions 52 and 56 (not shown in FIG. 4) associated with each of the clamping structures 18 and 20 will serve to retain the rebar 72 in its proper position transverse to and above the rebar 70. Base 12 provides a generally wide support area for the bar support apparatus 10.

Figure 5:
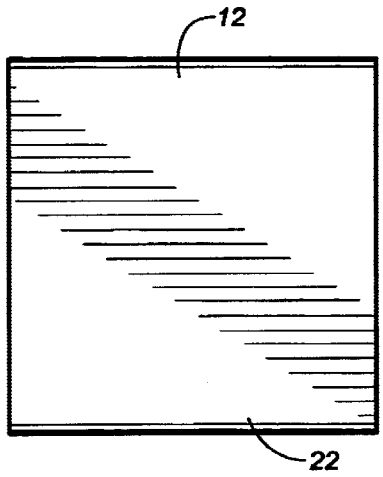
FIG. 5 is a bottom view of the bar support apparatus of FIG. 1 of the present invention.

FIG. 5 shows that the base 12 has a flat bottom surface 22. Base 12 is of generally a rectangular configuration. However, within the concept of the present invention, various other shapes of base 12 are contemplated within the scope of the present invention.

Figure 6:
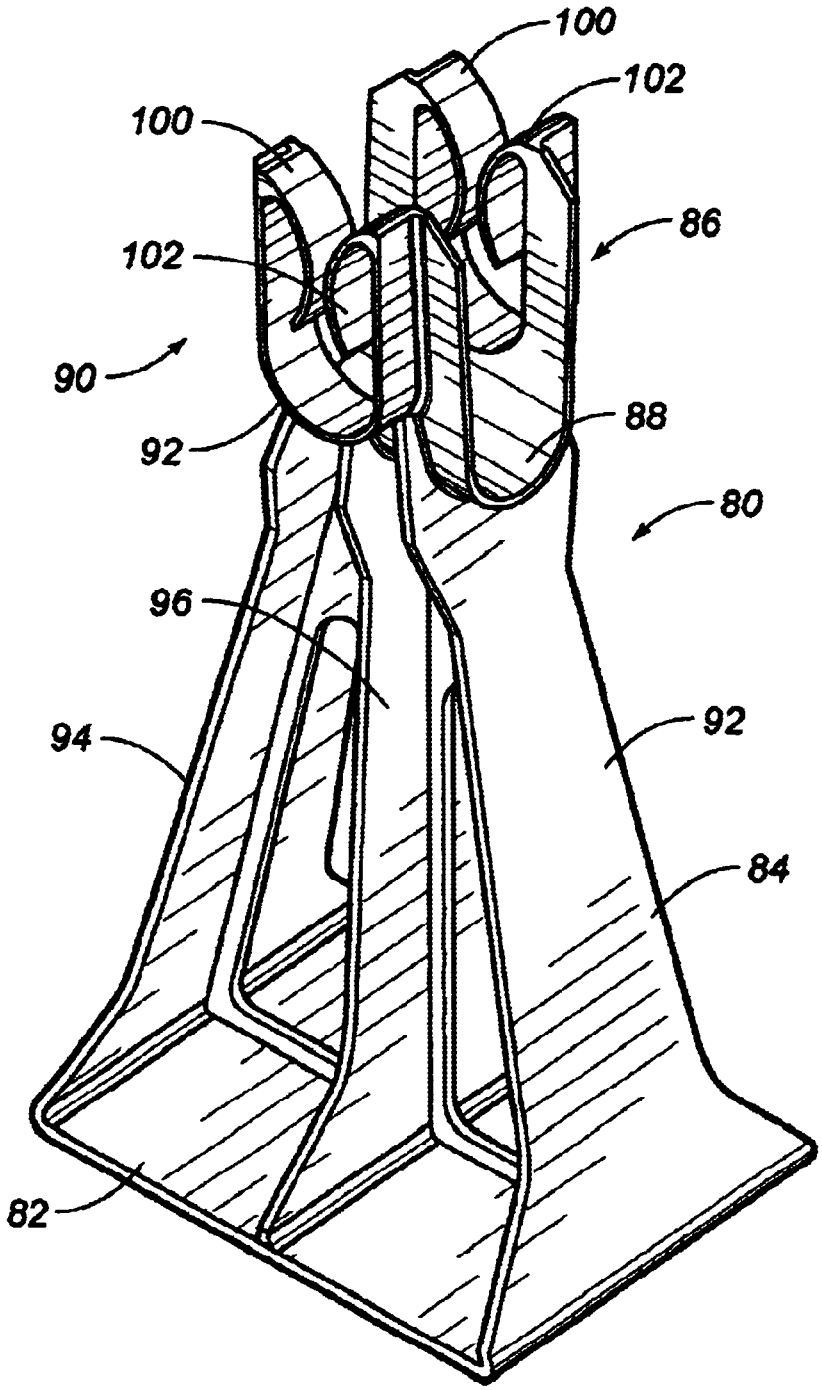
FIG. 6 is an upper perspective view of the preferred embodiment of the bar support apparatus of the present invention.

Referring to FIG. 6, there is shown the preferred embodiment of the bar support apparatus 80 in accordance with the teachings of the present invention. Bar support apparatus 80 includes a base 82, a support structure 84 extending upwardly from the base. 82, a first clamping structure 86 formed on one side of the channel 88 at an upper surface of the support structure 84 and a second clamping structure 90 formed on an opposite side of the channel 88 from the first clamping structure 86.

The base 82 is a generally flat surface. Support structure 84 has a first leg 92 and a second leg 94 extending angularly upwardly from the base 82. An intermediate leg 96 extends vertically upwardly between the legs 92 and 94 from the base 82. The channel 88 is formed at a top surface of the split structure 84 so as to have a shape configuration suitable for receiving a first rebar therein.

Unlike the previous form of the present invention, each of the first clamping structure 86 and the second clamping structure 90 has a generally U-shaped member 98 having a first curved element 100 extending inwardly from one side of the U-shaped member 98 and a second curved member 102 extending inwardly from an opposite side of the U-shaped member. The curved elements 100 and 102 extend inwardly and downwardly from the top end of the U-shaped member 98. As used herein, the curved elements 100 and 102 will be the "first retainer" and the "second retainer" for the rebar positioned therein.

Each of the curved elements has a curvature of greater that 90° and less than 180°. In the preferred form of the present invention, each of the curved elements 100 and 102 will have a curvature of approximately 120°. Each of the curved elements 100 and 102 has a concavity facing away from each other. The concavity of the curved element 100 faces one side of the U-shaped member. The concavity of the curved element 102 faces the opposite side of the U-shaped member 98. Each of the curved elements 100 and 102 is flexible. The inner ends of these curved elements 100 and 102 are spaced from the respective sides of the U-shaped member 98 and are also spaced from the bottom of the U-shaped member 98.

In normal use, when a rebar is placed between the curved, elements 100 and 102 and into the bottom of the U-shaped member 98, the exterior surfaces of these curved elements 100 and 102 will bear upon the exterior surface of the rebar therein. The configuration of these curved elements 100 and 102 will provide significant and unexpected resistance against the accidental release of the rebar from the area between the sides of the U-shaped member. The curved elements 100 and 102 will suitably be formed so as to prevent accidental release of the rebar from the interior of the U-shaped member. Additionally, it has been found that the flexibility and curvature of each of the curved elements 100 and 102 will allow various sizes of rebar to be placed within the U-shaped member 98.

Figure 7:
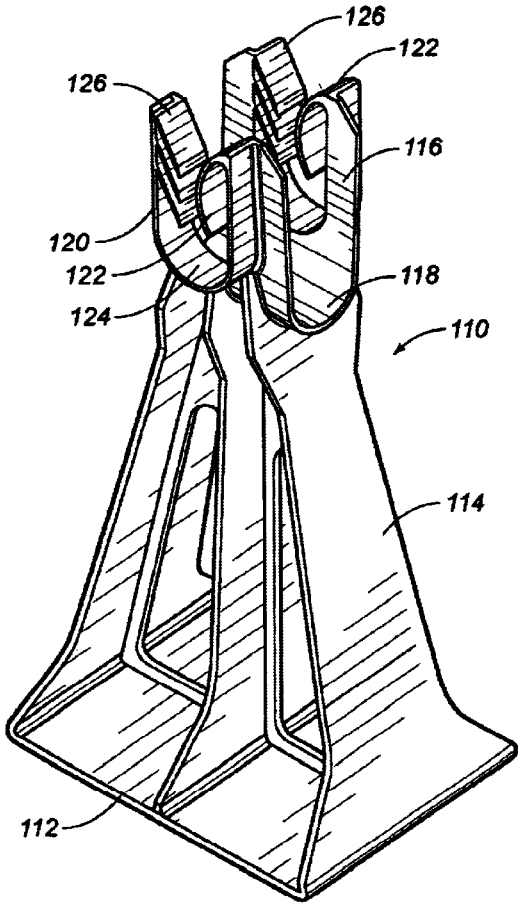
FIG. 7 is an upper perspective view of a first alternative embodiment of the bar support apparatus of FIG. 6.

FIG. 7 shows a first alternative embodiment 110 of the bar support apparatus of the present invention. Bar support apparatus 110, like the previous embodiments, includes a base 112 and a support structure 114. A first clamping structure 116 is formed on one side of channel 118 at the upper surface of the support structure 114. A second clamping structure 120 is formed on the opposite side of the channel 118 from that of clamping structure 116. It can be seen that the clamping structures 116 and 120 each include a curved element 122 on one side of the U-shaped member 124 and a plurality of ribs 126 formed on a opposite side of the U-shaped member 124. The plurality of ribs 126 face the convex side of the curved element 122.

The curved element 122 have a configuration similar to that of the curved elements 100 and 102 of the preferred embodiment of FIG. 6. In particular, each of the curved elements 102 has a curvature of between 90° and 180°. The curved element 122 extends from the top of the side of the U-shaped member 124 downwardly and inwardly toward the bottom of the U-shaped member 124. The inner end of the curved member 122 is spaced from the side and from the bottom of the U-shaped member 124.

The plurality of ribs 126 extend downwardly toward the U-shaped member 124. Each of the plurality of ribs 126 has an end adjacent to the curved element 122. When a rebar is placed within the clamping structures 116 and 120, the curved exterior surface of the curved elements 122 will bear against a surface of the rebar. Similarly, the outer ends of at least one of the plurality of ribs 126 will also bear against the exterior surface of the rebar. The curved element 122, along with the plurality of ribs 126, are particularly configured so as to retain the rebar within the U-shaped members 124 of the clamping structures 116 and 124. The curved element 122 and the plurality of ribs 126 are also configured so as to accept a wide variety of different sizes of rebar therein.

Figure 8:
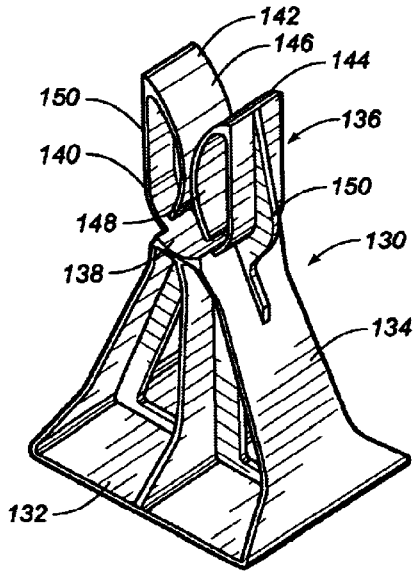
FIG. 8 is an upper perspective view of a second alternative embodiment of the bar support apparatus of FIG. 6.

FIG. 8 shows a second alternative embodiment of the bar support apparatus 130 of the present invention. Bar support apparatus 130 includes a base 132 and a support structure 134 extending upwardly from the base. A first clamping structure 136 is affixed to the support structure 134 and extends upwardly therefrom. The clamping structure 136 has an interior surface 138 suitable for receiving a rebar therein. This clamping structure 136 includes a generally U-shaped member 140 extending flexibly upwardly from the support structure 134. A first retainer 132 is affixed to an upper end of the U-shaped member 140. Similarly, a second retainer 144 is affixed to an upper end of an opposite side of the U-shaped member 140 and extends inwardly and downwardly therefrom. Each of the retainers 142 and 144 has a curved element formed thereon. In particular, the first retainer 144 has curved element 146 formed thereon. Similarly, the second retainer 144 has curved element 148 formed thereon. Each of the curved elements has a curvature of greater than 90° and less than 180°. Each of these curved elements 146 and 148 has an end spaced from the respective sides of the U-shaped member 140. These curved elements 146 and 148 are spaced above a bottom of the U-shaped member 140. A gusset 150 is formed on the exterior surface of each of the sides of the U-shaped member 140 so as to extend in support thereof from the support structure 134. Gussets 150 provide structural stability for the clamping structure 136.

The bar support apparatus 130 is not, specifically, an intersectional chair. In actual use, a rebar will be inserted between the retaining elements 142 and 144 so as to reside against the bottom 138 of the U-shaped member 140 of the clamping structure 136. The curved elements 146 and 148 will suitably retain the rebar within its desired location within the structure 136.

In each of the embodiments of the present invention, the close spacing of the retaining members will prevent the rebar from easily sliding outwardly therefrom. Although the rebar can be easily "directed" into the interior of the clamping structures, the rebar cannot be easily removed therefrom. The present invention provides a wide area base, in combination with inwardly angled legs, so as to keep the bar support apparatus 10 or 80 from being easily tipped over. The tapering and angled relationship of the respective legs of the support structure of the present invention provides superior load-resistive characteristics relative to that of the prior art. The configuration of the retaining portions 52 and 56, along with the plurality of ribs 100 and 102, are particularly configured so as to allow various diameters or rebars to be successfully retained within the apparatus 10 or 80 of the present invention. The present invention utilizes holes formed through the support structure so as to reduce the weight of the particular apparatus and also for allowing concrete flow therethrough. As a result, the apparatus of the present invention will not present a barrier to full concrete flow within the structure and will allow the concrete to flow freely therethrough.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A concrete reinforcing bar support comprising:

a base;

a support structure extending upwardly from said base, said support structure having a channel formed in an upper surface thereof, said channel extending in a direction and having a size suitable for receiving a first rebar therein;

a first clamping structure fixed to said support structure on one side of said channel, said first clamping structure having a curved element extending therein suitable for receiving a second rebar therein extending in a direction transverse to the first rebar; and a second clamping structure affixed to said support structure on an opposite side of said channel, said second clamping structure having a curved element extending therein suitable for receiving the second rebar therein, said second clamping structure being in spaced parallel relationship to said first clamping structure, each of said first and second clamping structures comprising:

a generally U-shaped member extending flexibly upwardly from said support structure;

a first retainer affixed to an upper end of one side of said U-shaped member and extending inwardly and downwardly therefrom, the curved element being formed on said first retainer; and a second retainer affixed to an upper end of an opposite side of said U-shaped member, said second retainer having a plurality of ribs extending angularly inwardly from said opposite side of said U-shaped member.

2. The bar support of claim 1, said curved element having a curvature of greater that 90° and less than 180°, said curved element having an end spaced from said one side of said U-shaped member.

3. The bar support of claim 1, each of plurality of ribs extending downwardly toward a bottom of said U-shaped member, each of said plurality of ribs having an end adjacent to said curved element of said first retainer.

4. The bar support of claim 1, each of said first and second clamping structures being positioned above said channel.

5. The bar support of claim 1, said base and said support structure and said first clamping structure and said second clamping structure being integrally formed together of a polymeric material.

6. The bar support of claim 1, said support structure having a plurality of holes formed therein so as to allow concrete to flow freely therethrough.

7. An apparatus comprising:

a base;

a support structure extending upwardly from said base, said support structure having a channel formed in an upper surface thereof;

a first clamping structure affixed to said support structure on one side of said channel, said first clamping structure having a first curved element extending therein;

a second clamping structure affixed to said support structure on an opposite side of said channel and arranged in generally spaced parallel relationship to said first clamping structure, said second clamping element having another curved element extending therein;

a first rebar extending in a direction and received in said channel of said support structure; and a second rebar retained by said first and second clamping structures in a position transverse to said first rebar and above said first rebar, each of said first and second clamping structures comprising:

a generally U-shaped member extending flexibly upwardly from said support structure;

a first retainer affixed to an upper end of one side of said U-shaped member and extending inwardly and downwardly therefrom, the curved element formed on said first retainer; and a second retainer affixed to an upper end of an opposite side of said U-shaped member, said first retainer having the curved element resiliently contacting an exterior surface of said second rebar, said second retainer having a surface resiliently contacting said exterior surface of said second rebar, said second retainer having a plurality of ribs extending angularly inwardly from said opposite side of said U-shaped member, at least one of said plurality of ribs contacting said exterior surface of said second rebar.

8. The apparatus of claim 7, said curved element having a curvature of greater than 90° and less than 180°, said curved element having an end spaced from said one side of said U-shaped member.

9. The apparatus of claim 7, said base and said support structure and said first clamping structure and said second clamping structure being integrally formed together of a polymeric material.

* * * * *